US012391460B2

(12) United States Patent
Boukidjian et al.

(10) Patent No.: US 12,391,460 B2
(45) Date of Patent: Aug. 19, 2025

(54) MODULAR DISPENSER

(71) Applicant: DIGNITY HEALTH, Phoenix, AZ (US)

(72) Inventors: Roy Boukidjian, Winnetka, CA (US); Gregoire Boukidjian, Winnetka, CA (US)

(73) Assignee: DIGNITY HEALTH, Phoenix, AZ (US)

( * ) Notice: Subject to any disclaimer, the term of this patent is extended or adjusted under 35 U.S.C. 154(b) by 0 days.

(21) Appl. No.: 16/643,523

(22) PCT Filed: Sep. 13, 2018

(86) PCT No.: PCT/US2018/050869
§ 371 (c)(1),
(2) Date: Feb. 28, 2020

(87) PCT Pub. No.: WO2019/055646
PCT Pub. Date: Mar. 21, 2019

(65) Prior Publication Data

US 2020/0361697 A1 Nov. 19, 2020

Related U.S. Application Data

(60) Provisional application No. 62/572,633, filed on Oct. 16, 2017, provisional application No. 62/557,833, filed on Sep. 13, 2017.

(51) Int. Cl.
*B65D 83/08* (2006.01)
*A47K 10/18* (2006.01)
(Continued)

(52) U.S. Cl.
CPC ..... *B65D 83/0805* (2013.01); *A47K 10/185* (2013.01); *A47K 10/42* (2013.01);
(Continued)

(58) Field of Classification Search
CPC .... A47K 10/42; A47K 10/185; A47K 10/421; A47K 2010/3233; A47K 2010/3246; A47K 2010/3266; A47K 2201/02; B65D 83/0805
See application file for complete search history.

(56) References Cited

U.S. PATENT DOCUMENTS 2,472,058 A * 6/1949 Artley ..... A47K 1/09 248/108
D285,529 S * 9/1986 Huxhold ..... D8/367
(Continued)

*Primary Examiner* — Gene O Crawford
*Assistant Examiner* — Kelvin L Randall, Jr.
(74) *Attorney, Agent, or Firm* — Pacer K. Udall; Booth Udall, PLC

(57) ABSTRACT

A modular dispenser is disclosed, having a first cover body with a first face having an aperture, and a second cover body hingedly coupled to the first cover body through at least one hinge. The first cover body and second cover body are movable between an open position and a closed position. The second cover body includes a second face that is opposite the first face of the first cover body when in the closed position. The first cover body and second cover body together define a cavity that may hold hygiene wipes or sanitizing gel. The modular dispenser also includes at least one attachment mechanism coupled to the second cover body, and a moisture lock coupled to one of the first cover body and the second cover body and disposed along the interface between the first cover body and the second cover body when in the closed position.

16 Claims, 15 Drawing Sheets

(51) Int. Cl.
*A47K 10/42* (2006.01)
*A47K 10/32* (2006.01)

(52) U.S. Cl.
CPC ..... *A47K 2010/3233* (2013.01); *A47K 2010/3266* (2013.01)

(56) References Cited

U.S. PATENT DOCUMENTS 4,856,744 A * 8/1989 Frankel ..... B62B 9/26 224/558
5,087,007 A * 2/1992 Gaderick ..... A47K 3/281 248/108
D336,842 S * 6/1993 Hampshire ..... D8/372
5,246,190 A * 9/1993 Swirkal ..... B60K 35/50 224/567
5,265,785 A * 11/1993 Chudy ..... B65D 83/0805 224/679
5,325,570 A * 7/1994 Chin-Ho ..... D06F 55/00 24/511
5,439,104 A * 8/1995 Wolska-Klis ..... G02C 13/006 206/233
D377,309 S * 1/1997 Hofman ..... D8/372
5,785,222 A * 7/1998 Basso ..... B60N 3/103 224/555
D445,332 S * 7/2001 Breiding ..... D9/416
6,283,334 B1 * 9/2001 Mahaffey ..... B65D 47/2031 222/212
6,427,293 B1 * 8/2002 Bowes, Jr. ..... F16B 45/02 24/3.12
6,543,737 B2 * 4/2003 Decker ..... A47K 10/185 248/905
6,842,951 B1 * 1/2005 Barre ..... B25B 7/02 24/515
7,185,864 B2 * 3/2007 Adams ..... A47G 25/0614 248/304
7,207,088 B2 * 4/2007 Adams ..... A47G 25/0614 16/404
D573,449 S * 7/2008 Goodman ..... D8/371
D617,998 S * 6/2010 Goodman ..... D6/323
7,992,833 B1 * 8/2011 Goodman ..... A47G 25/0614 248/339
8,132,692 B2 * 3/2012 Jordan ..... A61B 42/40 221/196
D766,707 S * 9/2016 Greenleaf ..... D8/367
D783,304 S * 4/2017 Gray ..... D6/515
D849,516 S * 5/2019 Johnson ..... D8/367
10,299,614 B2 * 5/2019 Adams ..... G09F 7/18
D858,261 S * 9/2019 Gong ..... D8/367
D859,132 S * 9/2019 Abeel ..... D8/367
D864,698 S * 10/2019 Wilson ..... A45F 5/00 D8/367
D898,548 S * 10/2020 Elliott ..... D8/372
2002/0113187 A1 * 8/2002 Decker ..... A47K 10/185 248/905
2007/0289988 A1 * 12/2007 Sosalla ..... F28D 20/023 221/150 A
2008/0067185 A1 * 3/2008 Schlaupitz ..... A47K 10/421 221/45
2008/0128571 A1 * 6/2008 Dostaler ..... B62B 3/1428 248/231.51
2010/0219199 A1 * 9/2010 Andochick ..... B60R 7/084 221/199
2010/0254123 A1 * 10/2010 Brown ..... A42B 1/244 362/191
2011/0017745 A1 * 1/2011 Michaels ..... A47K 10/42 220/521
2012/0074140 A1 * 3/2012 Pittman-Spears ..... A47K 5/12 220/200
2012/0118905 A1 * 5/2012 Lindbergh ..... A47K 10/421 221/197
2014/0334975 A1 * 11/2014 Geesbreght ..... A45F 5/021 222/108
2015/0173573 A1 6/2015 Dunn et al.
2015/0374182 A1 12/2015 Delaney
2020/0281374 A1 * 9/2020 Madueke ..... A45C 11/00

* cited by examiner

MODULAR DISPENSER

RELATED APPLICATIONS

This application is the U.S. National Stage of International Application No. PCT/US2018/050869, filed Sep. 13, 2018, which claims the benefit of U.S. provisional patent application No. 62/557,833, filed Sep. 13, 2017 titled "Systems and Methods for Modular Dispenser", as well as U.S. provisional patent application No. 62/572,633, filed Oct. 16, 2017 titled "Systems and Methods for Modular Dispenser", the contents of each of which are incorporated herein by reference in their entireties.

TECHNICAL FIELD

Aspects of this document relate generally to modular dispensers for use in a healthcare setting.

BACKGROUND

Hospitals go to great lengths to ensure a clean environment is maintained. Hand sanitization stations are never more than a few steps away, making it easy for almost everyone in the hospital to prevent transferring bacteria and viruses through contact. An exception to this are bedridden patients. While hand sanitization and other cleaning and hygiene products are often provided to these patients, they are rarely kept in a convenient location. Mobile tabletops are often moved to provide access to health care providers, and hygiene products are commonly placed out of the way on nearby tables. While moving hygiene wipes to a bedside table may seem to be a minor detail in the overall care of a patient, it may have dire consequences.

The last thing on a patient's mind while in a hospital bed, often experiencing pain, discomfort, or fear, is how to sanitize their hands before eating. Hygiene products moved out of the way of caregivers are commonly put out of sight, and therefore often out of mind, of the bedridden patient. Even if remembered, when sanitization requires a painful reach to a bedside table, or a call for assistance, it is often simply skipped, and the likelihood of hospital acquired infection increases.

SUMMARY

According to one aspect, a modular dispenser includes a first cover body with a first face having an aperture, and a second cover body hingedly coupled to the first cover body through at least one hinge. The first cover body and second cover body are movable between an open position and a closed position. The second cover body includes a second face that is opposite the first face of the first cover body when in the closed position. The first cover body and second cover body together define a cavity when in the closed position. The modular dispenser further includes at least one attachment mechanism integral with the second cover body, and a moisture lock comprising silicone and coupled to one of the first cover body and the second cover body and disposed along the interface between the first cover body and the second cover body when in the closed position.

Particular embodiments may comprise one or more of the following features. The modular dispenser may further include an aperture seal disposed over the aperture. The aperture seal may include an elastomeric material and may have a slit that may be biased closed. The modular dispenser may further include an aperture cover that may be hingedly coupled to the first cover body and may cover the aperture seal. The aperture cover may be composed of the same material as the first cover body. The modular dispenser may further include a gel dispensing mechanism that may be releasably coupled to the first cover body and may pass through the aperture. A volume enclosed by the first cover body may be less than ¼ a volume enclosed by the second cover body. The at least one attachment mechanism may include a clip. The clip may have a head portion partially encircling a receiving void and/or tapering downward to a tail portion that may have a tail end. The clip may be sufficiently flexible that the tail portion is deflectable away from the second cover body to a distance at least equal to a width of the receiving void. The tail end may be biased toward the second cover body. The receiving void may be at least 4 cm wide. The clip may further include a utility hanger extending outward from the clip, away from the second cover body, and/or curving upward. The first face and the second face may be substantially parallel while in the closed position. The first face and the second face may both be closer to vertical than horizontal when the at least one attachment mechanism is engaged with a hospital bed.

According to another aspect of the disclosure, a modular dispenser includes a first cover body having an aperture, and a second cover body hingedly coupled to the first cover body through at least one hinge. The first cover body and second cover body are movable between an open position and a closed position, the first cover body and second cover body together defining a cavity when in the closed position. The modular dispenser further includes at least one attachment mechanism coupled to the second cover body.

Particular embodiments may comprise one or more of the following features. The modular dispenser may further include a moisture lock that may include an elastomer coupled to one of the first cover body and the second cover body and/or disposed along the interface between the first cover body and the second cover body when in the closed position. The at least one attachment mechanism may include a loop that may have a flat side and/or a strap that may include an elastomer material and may pass through the loop to releasably couple to itself. The modular dispenser may further include a utility hanger coupled to one of the at least one attachment mechanism. The utility hanger may extend outward and away from the second cover body and/or curve upward. The modular dispenser may further include a lock coupled to the first cover body and may be movable between an unlocked position and a locked position. The lock may be engaged with a lock port on the second cover body while in the locked position.

According to yet another aspect of the disclosure, a modular dispenser includes a first cover body having an aperture, and a second cover body releasably coupled to the first cover body, the first cover body and second cover body together enclosing a cavity. The modular dispenser also includes at least one attachment mechanism coupled to the second cover body.

Particular embodiments may comprise one or more of the following features. The at least one attachment mechanism may include a clip. The clip may have a head portion partially encircling a receiving void and tapering downward to a tail portion that may have a tail end. The clip may be sufficiently flexible that the tail portion is deflectable away from the second cover body to a distance at least equal to a width of the receiving void. The tail end may be biased toward the second cover body. The clip further may further include an elastomeric material that may be non-slip along a segment of the head portion that may face the receiving void. The modular dispenser may further include an aperture seal disposed over the aperture. The aperture seal may include an elastomeric material and may have a slit.

Aspects and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112(f). Thus, the use of the words "function," "means" or "step" in the Detailed Description or Description of the Drawings or claims is not intended to somehow indicate a desire to invoke the special provisions of 35 U.S.C. § 112(f), to define the invention. To the contrary, if the provisions of 35 U.S.C. § 112(f) are sought to be invoked to define the inventions, the claims will specifically and expressly state the exact phrases "means for" or "step for", and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. § 112(f). Moreover, even if the provisions of 35 U.S.C. § 112(f) are invoked to define the claimed aspects, it is intended that these aspects not be limited only to the specific structure, material or acts that are described in the preferred embodiments, but in addition, include any and all structures, materials or acts that perform the claimed function as described in alternative embodiments or forms of the disclosure, or that are well known present or later-developed, equivalent structures, material or acts for performing the claimed function.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

The invention will hereinafter be described in conjunction with the appended drawings, where like designations denote like elements, and.

DETAILED DESCRIPTION

Figure 1:
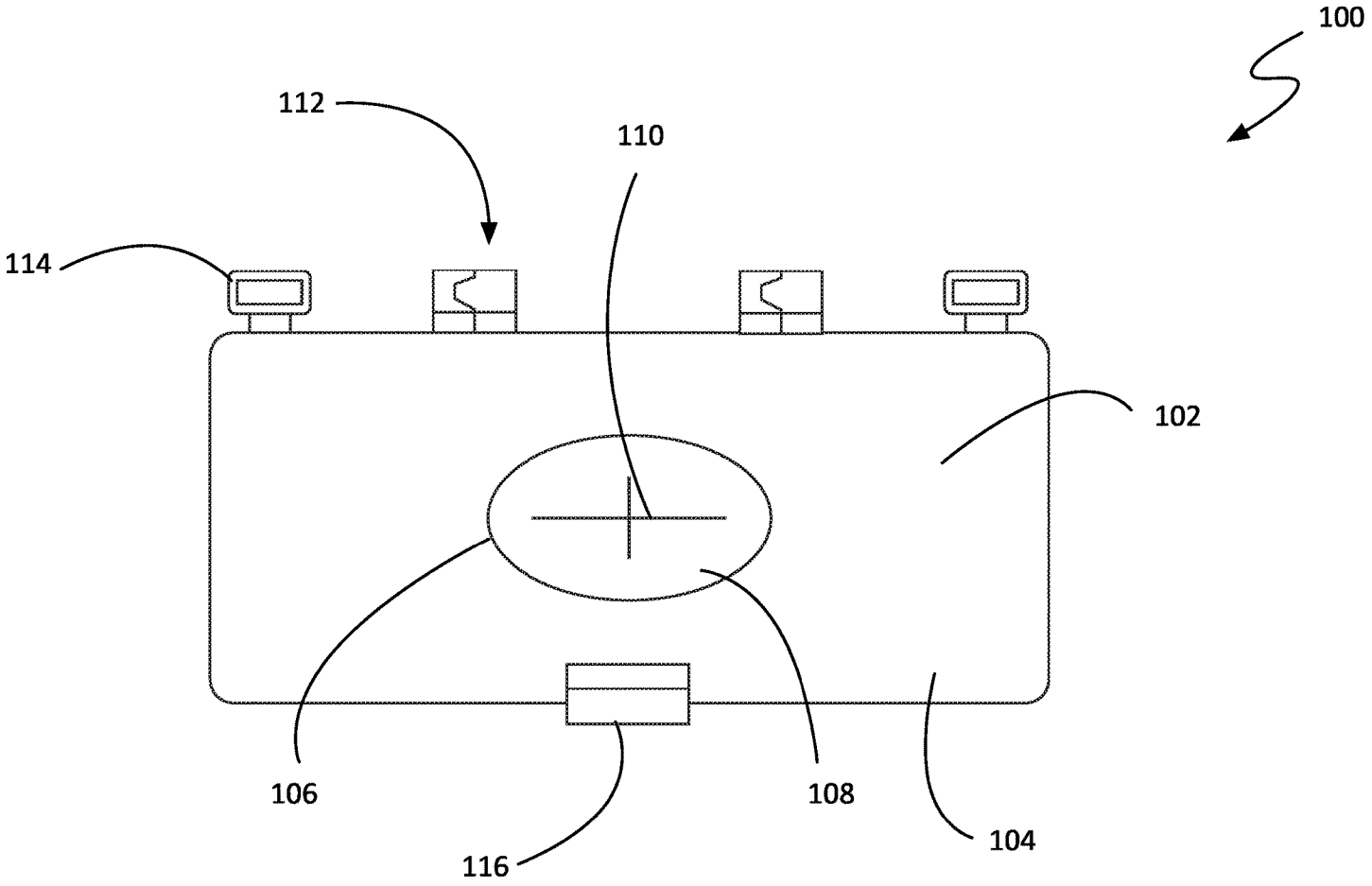
FIG. 1 is a front view of a modular dispenser.

This disclosure, its aspects and implementations, are not limited to the specific material types, components, methods, or other examples disclosed herein. Many additional material types, components, methods, and procedures known in the art are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of embodiments in many different forms, there is shown in the drawings and will herein be described in detail particular embodiments with the understanding that the present disclosure is to be considered as an exemplification of the principles of the disclosed methods and systems, and is not intended to limit the broad aspect of the disclosed concepts to the embodiments illustrated.

Hospitals and other healthcare facilities go to great lengths to ensure a clean environment is maintained. For example, hand sanitization stations are commonly never more than a few steps away, making it easy for almost everyone in the hospital to prevent transferring pathogens through contact. An exception to this are bedridden, or otherwise immobile or mobility impaired, patients. While hand sanitization and other cleaning products and materials (hereinafter referred to generally as hygiene products) are often provided to these patients, they are rarely kept in a convenient location. Over-bed tabletops are often moved to provide access to caregivers, and hygiene products are commonly placed out of the way on nearby tables. While moving hygiene products to a bedside table may seem to be a minor detail in the overall care of a patient, it may have dire consequences.

The last thing on a patient's mind while in a hospital bed, often experiencing pain, discomfort, or fear, is how to sanitize their hands before eating. Hygiene products moved out of the way of caregivers are commonly put out of sight, and therefore often out of mind, of the bedridden patient. Even if remembered, when sanitization requires a painful reach to a bedside table, or a call for assistance, it is often simply skipped, and the likelihood of hospital acquired infection increases.

Contemplated herein is a modular dispenser that provides 24-hour direct access to hygiene products for substantially immobile patients without impeding medical care. Various embodiments of the modular dispenser are configured to be attached (releasably) to an item of medical equipment/furniture/structure, such as a hospital bed, a gurney, or other item that can support a patient. Since the modular dispenser does not have to rest on a flat surface such as a table, but instead can be attached to something a patient has access to, it may be placed within reach of the patient without obstructing the access of a caregiver or interfering with the operation of medical equipment (e.g. movable hospital beds, etc.)

Different embodiments of the modular dispenser can be used to dispense a variety of hygiene products, including but not limited to hygiene wipes and sanitizing gel for one or more extremities of an individual in need thereof, such as an individual that is substantially or completely immobile. For example, in some embodiments, the modular dispenser can be configured and arranged to dispense hygiene wipes that the patient can access after an event that may have soiled the patient's extremities (e.g., using a bedpan or a urinal, sneezing, using a tissue to clean his or her nose, etc.) or can access the hygiene wipes prior to an event for which the patient desires clean extremities (e.g., prior to eating).

Figure 2:
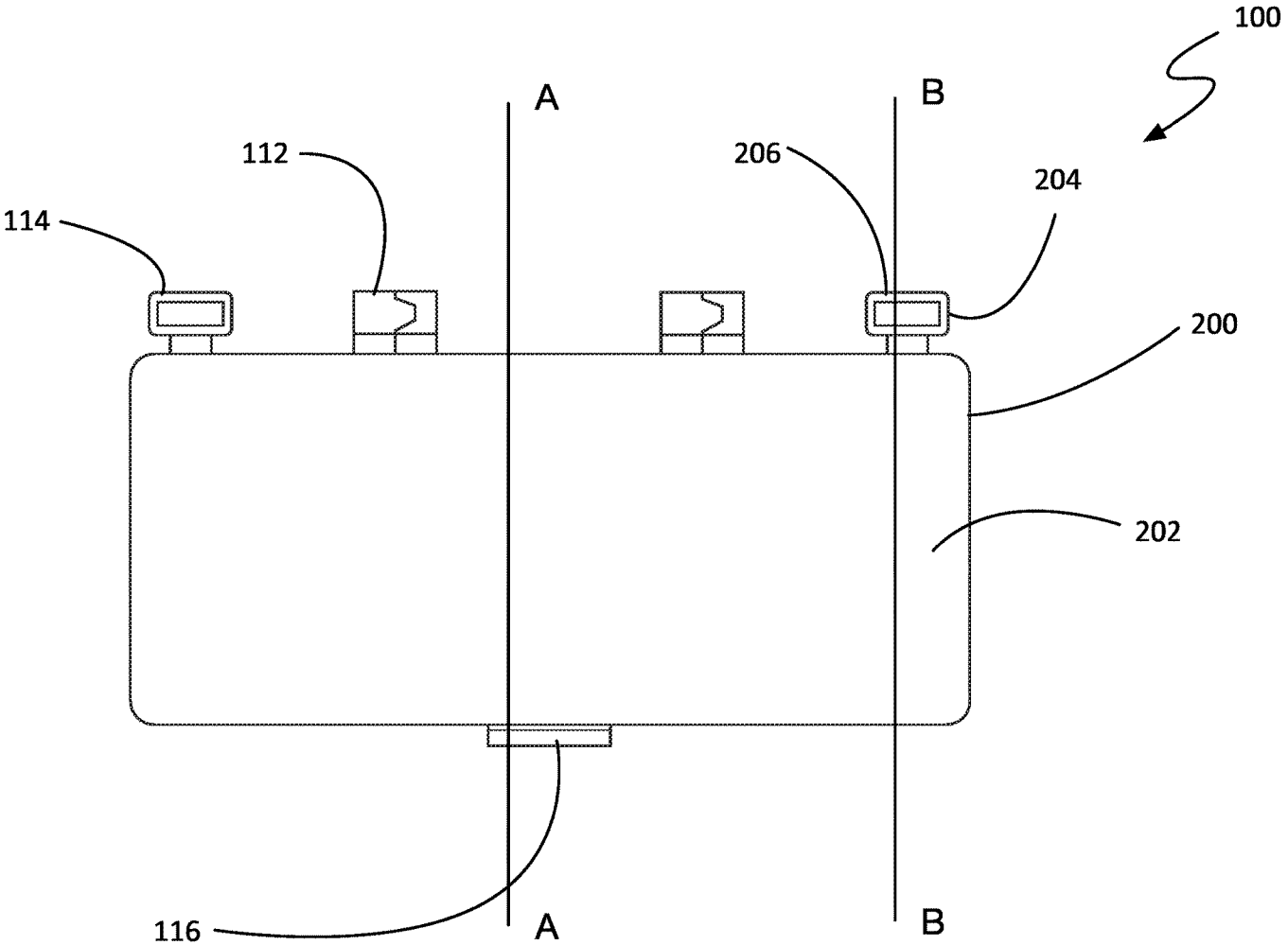
FIG. 2 is a rear view of a modular dispenser.
Figure 3A:
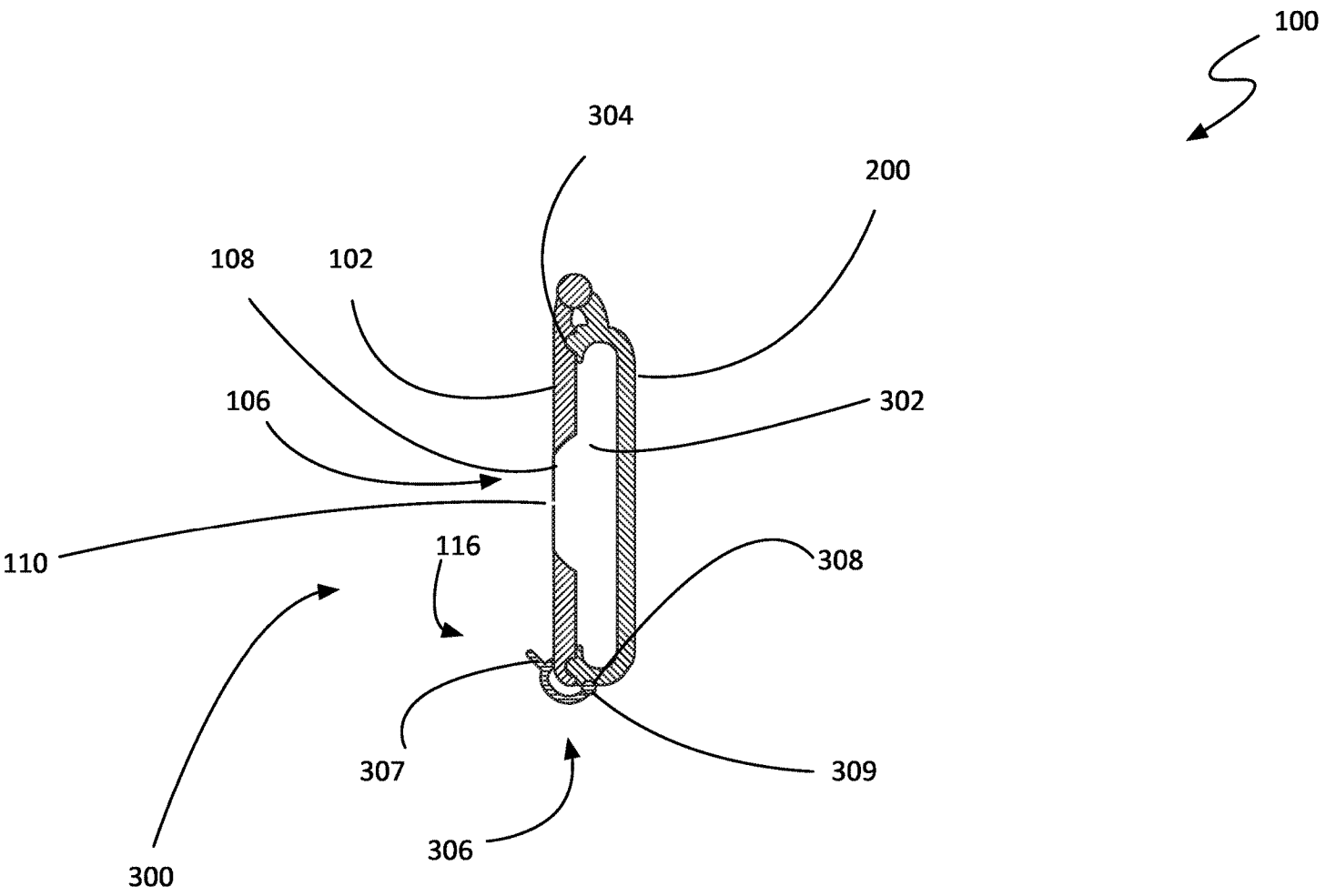
FIGS. 3*a* and 3*b* are cross-sectional views of the modular dispenser of FIG. 2 in closed and open configurations, respectively.
Figure 3B:
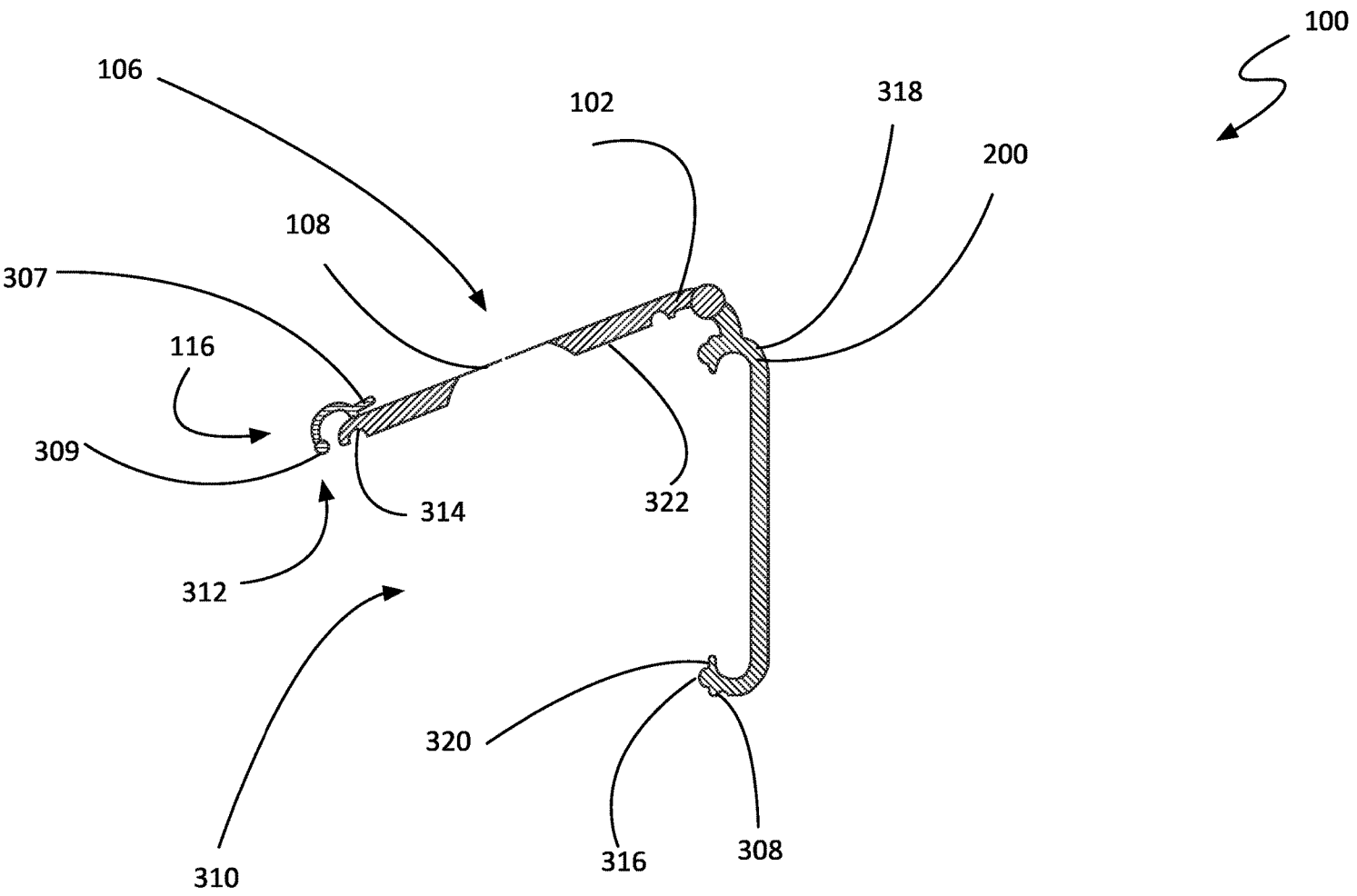

FIGS. 1-3 show various views of a non-limiting example of a modular dispenser 100. Specifically, FIG. 1 shows a front view, FIG. 2 shows a rear view, FIG. 3*a* shows a cross sectional view along A-A of the modular dispenser 100 in a closed position, and FIG. 3*b* shows that same cross section while in an open position. It should be noted that, particularly in cross section views, the relative thickness of different elements should be taken as representative, and not to scale. According to various embodiments, elements depicted as having the same thickness or other dimension may differ in other embodiments and implementations.

As shown, the modular dispenser 100 comprises a first cover body 102, a second cover body 200, and at least one attachment mechanism 114. The first cover body 102 is coupled to the second cover body 200, together forming or defining a cavity 302 from which a hygiene product is dispensed. It should be noted that while the figures of this disclosure depict embodiments configured for dispensing hygiene wipes and sanitizing gel, other embodiments may be configured for the dispensing of additional or multiple types of hygiene products.

According to various embodiments, the first cover body 102 and second cover body 200 are able to move with respect to each other. In some embodiments, the first cover body 102 and second cover body 200 may be integral with each other and formed as a single unit. For example, in one embodiment, the two bodies may be formed as a single piece, connected by a segment of material that is thin enough to flex, allowing the two bodies to hinge open and closed.

In other embodiments, including the non-limiting example shown in FIGS. 1-3, the cover bodies 100, 200 may be formed separately and then coupled to each other. For example, in some embodiments, the first cover body 102 may be coupled to the second cover body 200 through one or more hinges 112, allowing the first and second cover bodies to hinge with respect to each other between an open position 310 and a closed position 300.

In the context of the present description and the claims that follow, a closed position 300 is a configuration of the first cover body 102 and the second cover body 200 such that an enclosed cavity 302 has been formed and the hygiene product is contained (e.g. it will not fall out of the cavity 302 while in an intended orientation, etc.). Furthermore, an open position 310 is any position that is not a closed position 300. According to various embodiments, the modular dispenser 100 may be placed in an open position 310 to deposit hygiene product into the dispenser 100, and placed in a closed position 300 so the hygiene product may be dispensed to a user (e.g. patient, etc.).

According to various embodiments, the cavity 302 can extend some or all of the length and width of the internal area of the modular dispenser 100. As such, the user/patient can access the cavity 302 by reaching through the aperture 106 and the aperture seal 108. In some embodiments, one or more items of interest to the user/patient can be at least partially positioned within the cavity 302. For example, in some embodiments, one or more hygiene wipes can be positioned within the cavity 302 and accessed by the patient (e.g., via the aperture 106 and aperture seal 108). In particular, the hygiene wipes may comprise/be impregnated with a compound that is capable of substantially sanitizing a portion of the user's body. For example, in some embodiments, the hygiene wipes may be impregnated with an alcohol-based solution that is of a sufficient concentration to at least partially sanitize the user's hands after using a bedpan or urinal and/or prior to eating or drinking. In other embodiments, the hygiene wipes can be impregnated with any other form of sanitizing solution/compound. In yet other embodiments, the hygiene wipes may not be impregnated with any sanitizing solution and may be dry tissues and/or comprise other compounds and solutions for washing and cleaning the patient.

In some embodiments, the modular dispenser 100 may have a substantially rhombohedral shape. For example, the dispenser 100 may be a thin, rectangular box, sized to hold hygiene wipes. As a specific example, the modular dispenser 100 shown in FIGS. 1-3, having a first face 104 and a second face 202 that are substantially parallel when in the closed position 300, may be engaged with a structure near the patient using one or more attachment mechanisms such that the first face 104 and second face 202 are closer to vertical than horizontal, allowing the hygiene product to be dispensed in a substantially vertical direction. This allows the patient to simply pull towards themselves, rather than having to pull upward then inward.

In other embodiments, the modular dispenser 100 may have other shapes, such as cylindrical. In some embodiments, the shape of the modular dispenser 100, or more specifically, the shape of the cavity 302 within the dispenser 100, may be configured to receive a hygiene product that is stored or delivered in a standardized or common packaging, shape, form, or arrangement.

As previously mentioned, some embodiments of the modular dispenser 100 comprise cover bodies that are hingedly coupled through one or more hinges 112. The non-limiting example shown in FIGS. 1-3 employs two male/female hinges. Male/female hinges are advantageous as they may be formed entirely through injection molding of plastic, and thus can be formed integral with and simultaneous to the first cover body 102 and second cover body 200. Those skilled in the art will recognize that other numbers, sizes, and types of hinges may be used to movably couple the first cover body 102 and the second cover body 200. In some embodiments the hinges 112 may be formed integral with one or both cover bodies, while in other embodiments the hinge or hinges 112 may be affixed to the two bodies after formation. In still other embodiments, the first cover body 102 may be releasably coupled to the second cover body 200 without using hinges. Exemplary coupling methods include, but are not limited to, threading, magnets, friction fitting, snap-ins, and the like.

In some embodiments, the first cover body 102 may have a first face 104 that may be the largest facet or substantially planar surface of the first cover body 102, and the second cover body 200 may have a second face 202. In some embodiments, the second face 202 may be opposite, and substantially parallel to (i.e. parallel within 15 degrees) the first face 104. In other embodiments, the first and second faces may be non-parallel, and in yet other embodiments, the second cover body 200 may not have a planar surface or face.

The first and second cover bodies may be formed from various materials that are compatible with the overall goal of reducing the transfer of pathogens. They may comprise a substantially inert material that will pose little to threat of physical harm to a patient. For example, in some embodiments, the first and second cover bodies 100, 200 may be made from a sterilizeable or washable plastic, thermoplastic, or other polymer is substantially moisture proof and sufficiently non-porous that it does not pose a substantial threat of harboring bacteria or is difficult to disinfect. The use of thermoplastics may be advantageous, in that the cover bodies may be formed through injection molding. In other embodiments, the first and second cover bodies 100, 200 may be formed from any hard material that is substantially inert and that does not pose a risk to the patient. In still other embodiments, the first and second cover bodies 100, 200 may be formed from material that is not able to be repeatedly disinfected, but is intended for use by a single patient and then discarded rather than being refilled and/or sanitized for another patient to use.

The first cover body 102 may comprise at least one aperture 106. According to various embodiments, the first face 104 of the first cover body 102 may comprise an aperture 106 through which a hygiene product or other material within the cavity 302 may be dispensed or accessed without requiring the modular dispenser 100 to be placed in an open position 310.

In some embodiments, an aperture seal 108 may be coupled to or substantially integral with the first cover body 102 to substantially cover the aperture 106. In some embodiments, the aperture seal 108 can provide a point of access to the internal cavity 302 of the modular dispenser 100 while also providing a partial seal (e.g., the aperture seal 108 can be substantially moisture-proof).

For example, the aperture seal 108 can comprise a flexible material (e.g., elastomer, silicone, etc.) and may have one or more access portals or openings that can provide access to the area internal to the modular dispenser 100 when the patient or other user needs to access the cavity 302. In some embodiments, the aperture seal 108 may have one or more slits 110 that are biased closed. In the context of the present disclosure and the claims that follow, a slit that is biased closed refers to an elongated opening or incision in an aperture seal 108 wherein the slit is narrow enough and/or the seal 108 is thick enough that in the absence of a penetrating object (e.g. hand, finger, etc.), the slit 110 will tend toward (i.e. bias towards) a closed state. As a specific example, this closed state may be tight enough to prevent or at least inhibit transfer of moisture or vapor from the cavity 302 to the outside. This may facilitate the dispensing of moistened hygiene wipes while preventing them from quickly drying out.

By way of example only, the user can put a finger, fingers, or hand through the aperture seal 108 to access the internal cavity 302. In some embodiments, the aperture seal 108 can be coupled to the first face 104. In other embodiments, the aperture seal 108 can be substantially integral with the first face 104.

In some embodiments, the modular dispenser 100 may comprise one or more locks 116 that prevent accidental opening of the dispenser 100. For example, a lock 116 can be positioned on or along a side of the modular dispenser 100 that opposes the hinge 112 or hinges 112. In some embodiments, including the non-limiting example shown in FIGS. 1-3, the lock may be positioned on the first cover body 102, while in others it may be positioned on the second cover body 200. In some embodiments, the lock 116 may comprise a lever 307 that is movably (e.g., pivotably) engaged to the first cover body 102 and a lock member 309 that is capable of engaging a lock port 308 defined on the second cover body 200 (see FIGS. 3*a* and 3*b*). For example, the lever 307 can be pivotably engaged with the first cover body 102 such that the user/patient can move the lever 307 to seal and unseal the cavity 302. Moreover, in some embodiments, the lock port 308 and the lock member 309 can be configured and arranged so that, when the user desires to lock together the first and second cover bodies 102, 200 the user can actuate the lever 307 to move the lock member 309 to be at least partially received within and engage the lock port 308, placing it in a locked position 306.

In some aspects, the lock port 308 can comprise a substantially semi-circular-like configuration and the lock member 309 can comprise a similar circular or semi-circular-like configuration to be received within and engage the lock port 308. In other embodiments, the lock port 308 and the lock member 309 can comprise any other shape desired. In addition, the lock port 308 and the lock member 309 can be sized and dimensioned such that the lock member 309 remains engaged in the lock port 308 until the user again actuates the lever 307 to remove the lock member 309 from the lock port 308, placing it in an unlocked position 312. In such a case, the user/patient can then move the first and/or second cover bodies 102, 200 with respect to each other.

In some embodiments, the modular dispenser 100 can operate without the aperture 106 and aperture seal 108. For example, in some aspects, in order to access the recess 312, the user/patient can actuate the lever 307 of the lock 116 to disengage the lock member 309 from the lock port 308 so that the user can access the recess 312 and any item(s) contained therein.

In some embodiments, the modular dispenser 100 may comprise at least one attachment mechanism 114. In the context of the present description and the claims that follow, an attachment mechanism 114 is a structure that allows the modular dispenser 100 to be attached to something that places the dispenser 100 within easy reach of the patient but out of the way of caregivers. For example, an attachment mechanism 114 may allow the modular dispenser 100 to be attached to the rail of a hospital bed.

In some embodiments, the modular dispenser 100 may comprise one or more attachment mechanisms 114. Furthermore, in some embodiments, a modular dispenser 100 may comprise more than one type of attachment mechanism 114. Different types of attachment mechanisms 114 will be discussed in greater detail below, with respect to FIGS. 6-11.

In some embodiments, one or more attachment mechanisms 114 may be disposed substantially adjacent to a hinge or hinges 112. By way of example only, in some embodiments, the attachment mechanisms 114 may be disposed substantially adjacent to an edge or corner of the modular dispenser 100, as illustrated in the figures referenced above. In other embodiments, the attachment mechanisms 114 can be positioned at or along any other portion of the modular dispenser 100.

In some embodiments, the second cover body 200 can comprise the attachment mechanism(s) 114. For example, in some embodiments, the attachment mechanisms 114 can be coupled to the second cover body 200 prior to use. In other embodiments, the second cover body 200 can be manufactured such that one or more attachment mechanisms 114 are integral with the second cover body 200. Moreover, in some embodiments, the attachment mechanisms 114 may comprise a material that is the same or substantially similar as the material used to manufacture the second cover body 200. In other embodiments, the attachment mechanisms 114 may comprise a different material. For example, in some aspects, the attachment mechanisms 114 may comprise a more flexible material (e.g., silicone, elastomer, etc.) compared to the rest of the modular dispenser 100 (e.g., polymer, thermoplastic, etc.).

In some embodiments, the modular dispenser 100 can comprise a moisture lock 304, to inhibit the dehydration or leaking of materials within the cavity 302. For example, in some embodiments, one or more hygiene wipes can be positioned within the cavity 302 and some of the wipes may comprise a sanitizing solution. As such, it can be desirable to retain some or all of the moisture/sanitizing solution impregnated within the hygiene wipes. In some embodiments, the modular dispenser 100 may comprise the moisture lock 304 to provide such moisture retention within the cavity 302.

In some embodiments, the first and second cover bodies 102, 200 may comprise different portions of the moisture lock 304. For example, in some embodiments, the first cover body 102 may comprise a first portion 314 of the moisture lock and the second cover body 200 may comprise a second portion 316 of the moisture lock. In some embodiments, the first portion 314 of the moisture lock may be configured as a groove 314 or female lock. For example, the first portion/groove 314 may disposed substantially adjacent to the edge of the first cover body 102 and may run a partial or a complete length of a perimeter of the first cover body 102. More specifically, in some aspects, the groove 314 may be defined substantially adjacent to the edge and along a portion of an inner surface 322 of the first cover body 102. In some embodiments, the first cover body 102 can be formed such that the groove 314 is defined upon manufacture. In other embodiments, the groove 314 can be formed in the inner surface 322 of the first cover body 102 after manufacture.

In these embodiments, the second cover body 200 can comprise the second portion 316 of the moisture lock 304. For example, as shown, the edge of the second cover body 200 can comprise a curved region 318 and an engagement region 320. As illustrated in the cross-sectional view of FIG. 3*a*, when the first and second cover bodies 102, 200 are coupled together, the curved region 318 can extend from the second cover body 200 toward the first cover body 102 and the engagement region 320 can be configured and arranged to engage the inner surface 322 of the first cover body 102. For example, in some embodiments, the second portion 316 of the moisture lock 304 can be configured as a male member 316 that extends from the engagement region 320 and engages with the groove/first portion 314 of the moisture lock 304 to provide a moisture seal. Moreover, the male member 316 can extend along a partial or complete length of a perimeter of the second cover body 200. For example, the male member 316 can be provided for substantially the same length as the length of the groove 314 on the first cover body 102. As such, upon closure of the first and second cover bodies 102, 200, the male member 316 can be at least partially received within the groove 314 to reduce and/or eliminate any fluid circulation (e.g., air circulation) within the cavity 302. As a result, the cavity 302 remains substantially sealed because of the substantially or complete moisture-tight seal formed by the first and second portions 314, 316 of the moisture lock 304.

In other embodiments, the moisture lock 304 may be formed by the placement of an elastomer material along the interface between the first cover body 102 and the second cover body 200 when they are in the closed position. Said material may be coupled to either of the bodies, or may be split between the two bodies. As an option, an elastomer material may be employed along with other embodiments of the moisture lock 304. For example, an elastomer material may be placed between the first portion 314 and second portion 316 of the previously discussed moisture lock 304.

Figure 4:
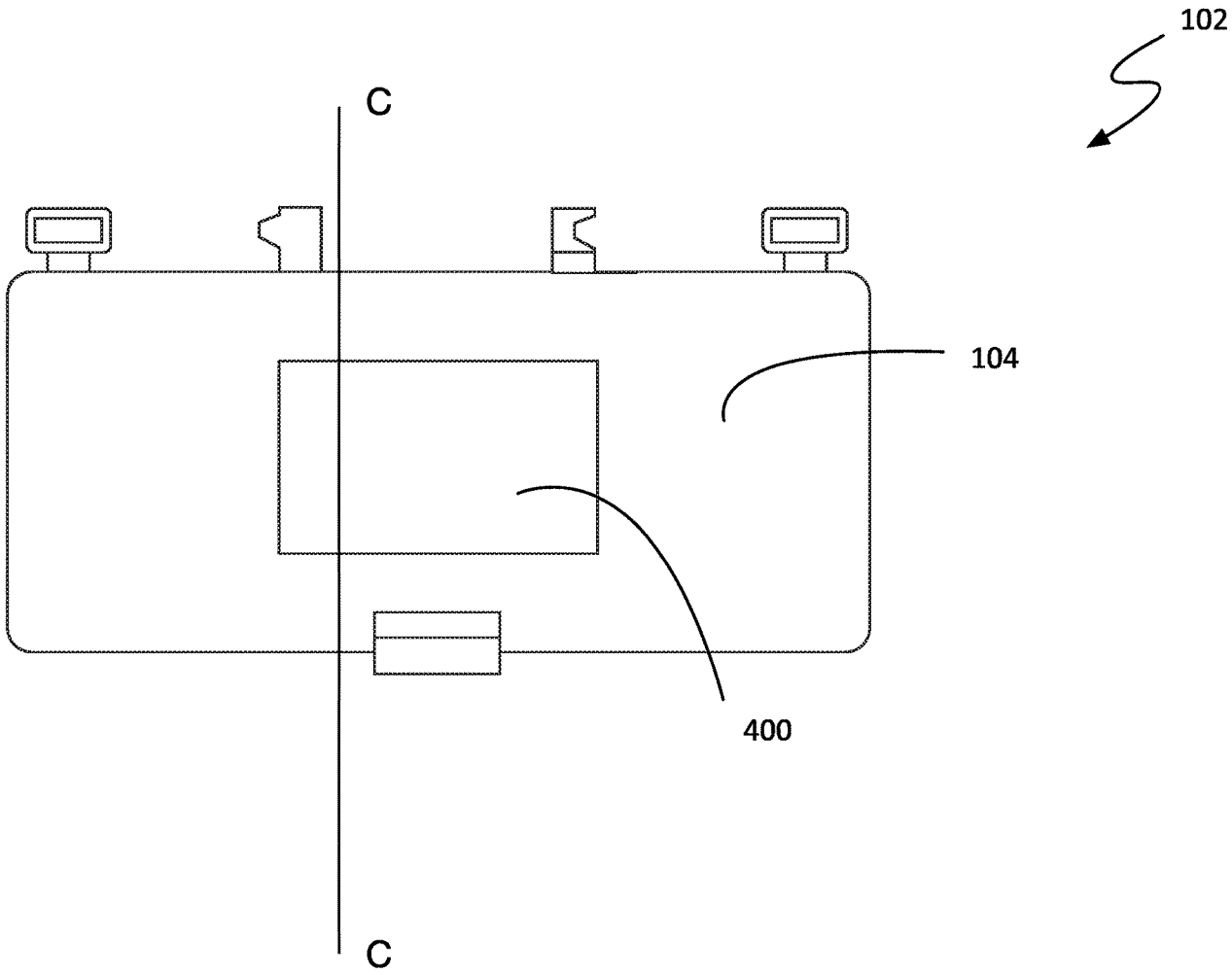
FIG. 4 is a front view of a first cover body.
Figure 5:
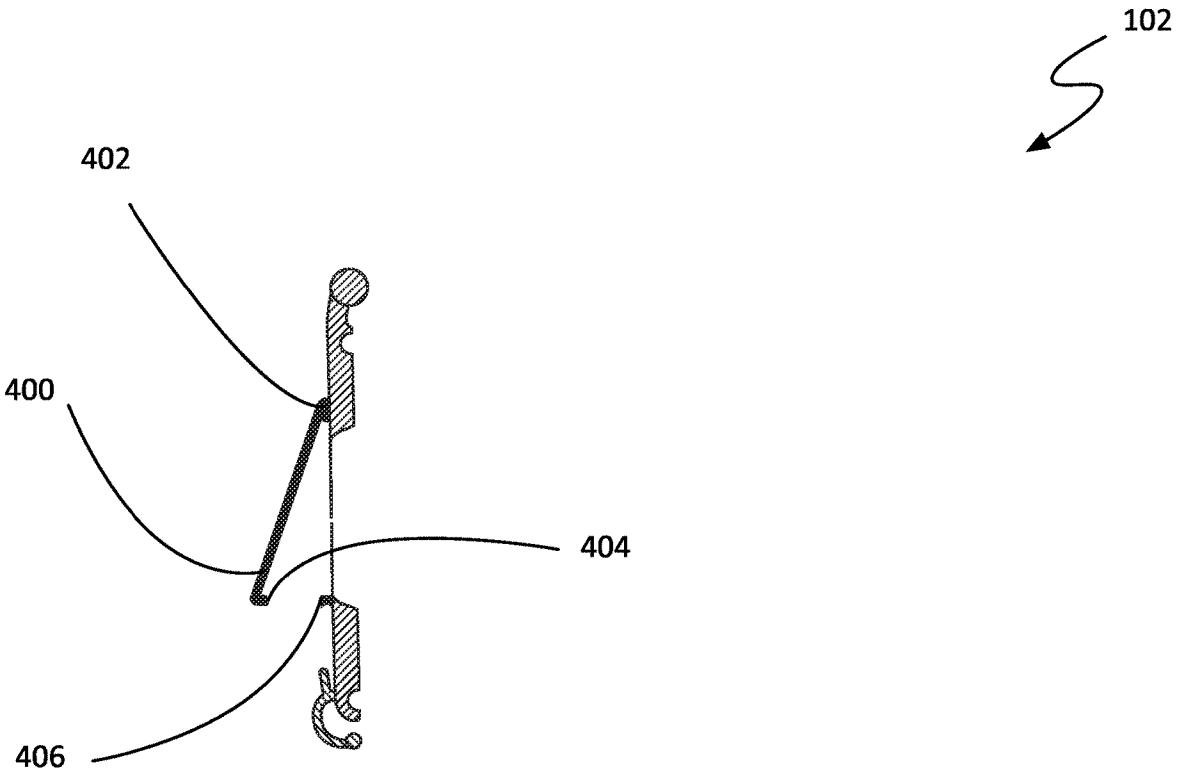
FIG. 5 is a cross-sectional view of the first cover body of FIG. 4.

Referring now to FIGS. 4 and 5, a front cover body 102 may further comprise an aperture cover 400. For example, as previously mentioned, it may be desirable to retain moisture within one or more items disposed within the cavity 302 (e.g., sanitizing compound contained within hygiene wipes, etc.). Accordingly, the aperture cover 400 can be configured and arranged to substantially or completely seal (e.g., moisture-tight seal) the area substantially or immediately adjacent to the aperture 106 and aperture seal 108 to provide substantial or complete moisture retention within and around the items disposed within the cavity 302. As an option, the cover 400 may be composed of the same material as the first cover body 102.

In some embodiments, the aperture cover 400 may comprise a hinge 402, an aperture cover male member 404, and an aperture cover female member 406. For example, the hinge 402 may be coupled to or substantially integral with the first cover body 102. Moreover, the hinge 402 may provide the ability to move the aperture cover 400. For example, the hinge 402 may provide the ability to move the aperture cover 400 between 1 and 180 degrees to enable the user to access the cavity 302 via the aperture 106 and/or aperture seal 108. Moreover, in some embodiments, a portion of the aperture cover 400 may be configured as the aperture cover male member 404 and the aperture cover female member 406 may be coupled to and/or substantially or completely integral with the first cover body 102. As such, the aperture cover male member 404 and the aperture cover female member 406 can engage each other when the user desires the aperture cover 400 to be in a closed position. When engaged, the aperture cover male member 404 and the aperture cover female member 406 can provide the substantial or complete moisture seal of the aperture 106 and/or aperture seal 108. Conversely, the user can disengage the aperture cover male member 404 from the aperture cover female member 406 to access the cavity 302 via the aperture 106 and/or aperture seal 108.

As illustrated in FIG. 5, the hinge 402 may be positioned substantially or immediately adjacent to a first side of the aperture 106 and/or aperture seal 108 and the aperture cover female member 406 can be positioned on an opposing side. As such, the hinge 402 can provide the movement capability for the aperture cover 400 and the aperture cover male and female members 404, 406 can provide sealing/locking capabilities.

FIGS. 6-11 show non-limiting examples of different kinds of attachment mechanisms 114, specifically a clip 600, a strap 900, and a clamp 1000. Those skilled in the art will recognize that other attachment mechanisms 114 may also be employed to couple a modular dispenser 100 to a structure or object within a hospital or healthcare setting, as previously discussed.

Figure 6:
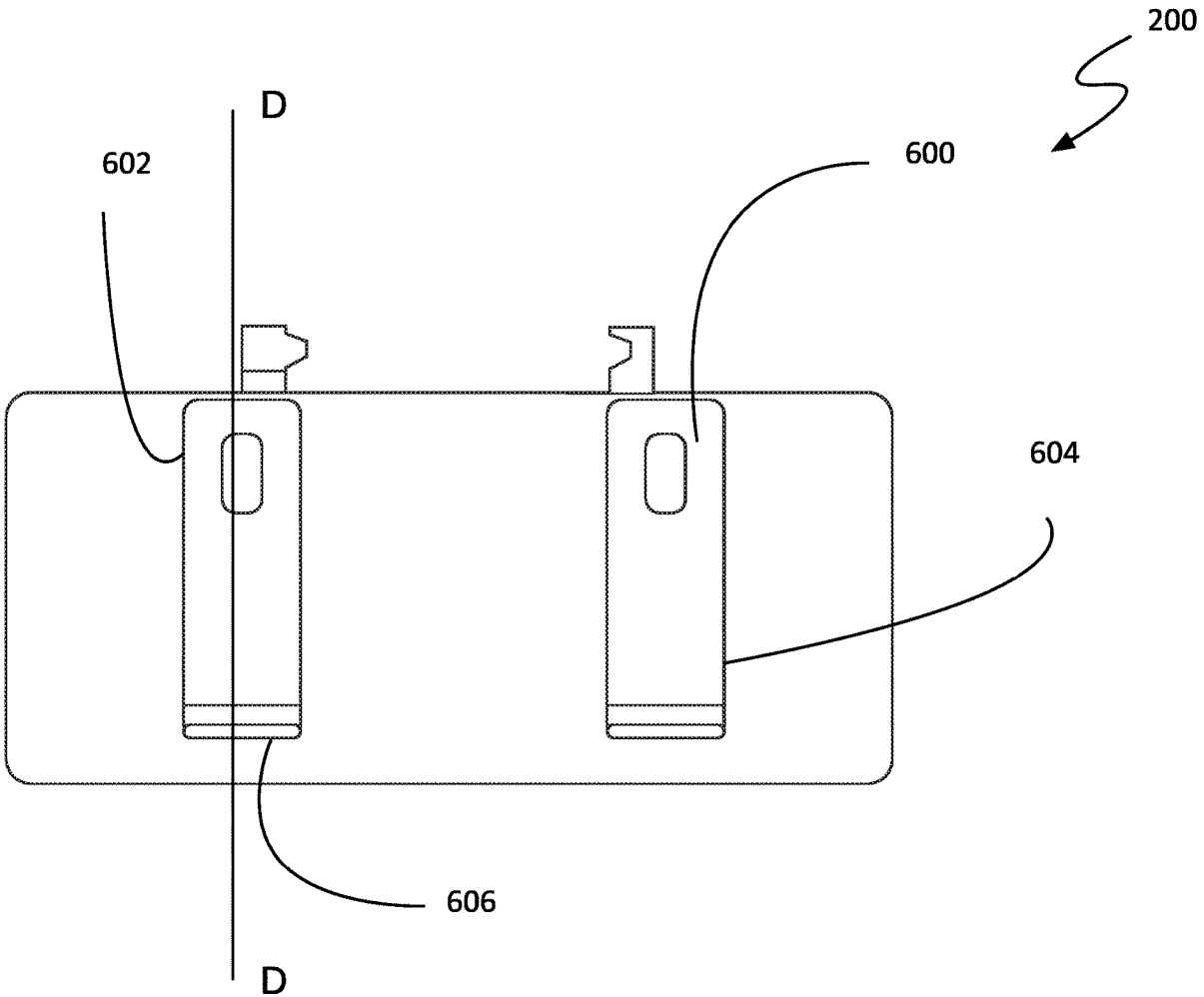
FIG. 6 is front view of a second cover body having a clip.
Figure 10:
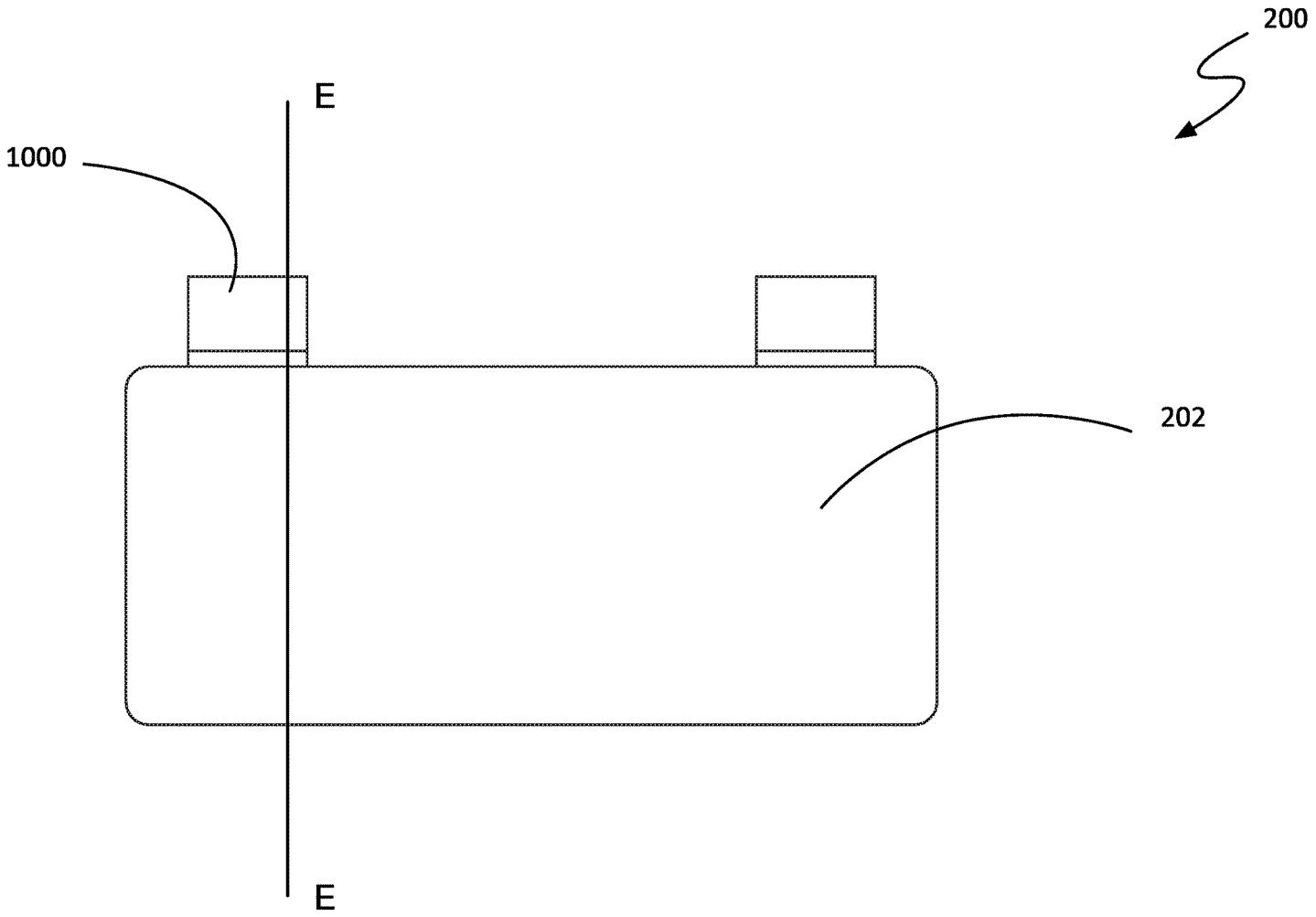
FIG. 10 is a front view of a second cover body having a clamp.

FIGS. 2, 6, and 10 show views of various attachment mechanisms 114 coupled or integral with the second cover body 200. In some embodiments, an attachment mechanism 114 may be coupled to or integral with the second cover body 200, while in others it may be coupled to or integral with the first cover body 102. The following discussion of three different examples of attachment mechanisms 114 will be done in the context of their being formed integral with a second cover body 200. However, it should be noted that this is for exemplary purposes only, and that in other embodiments these and other attachment mechanisms 114 could be coupled or part of a first cover body 102.

Figure 7A:
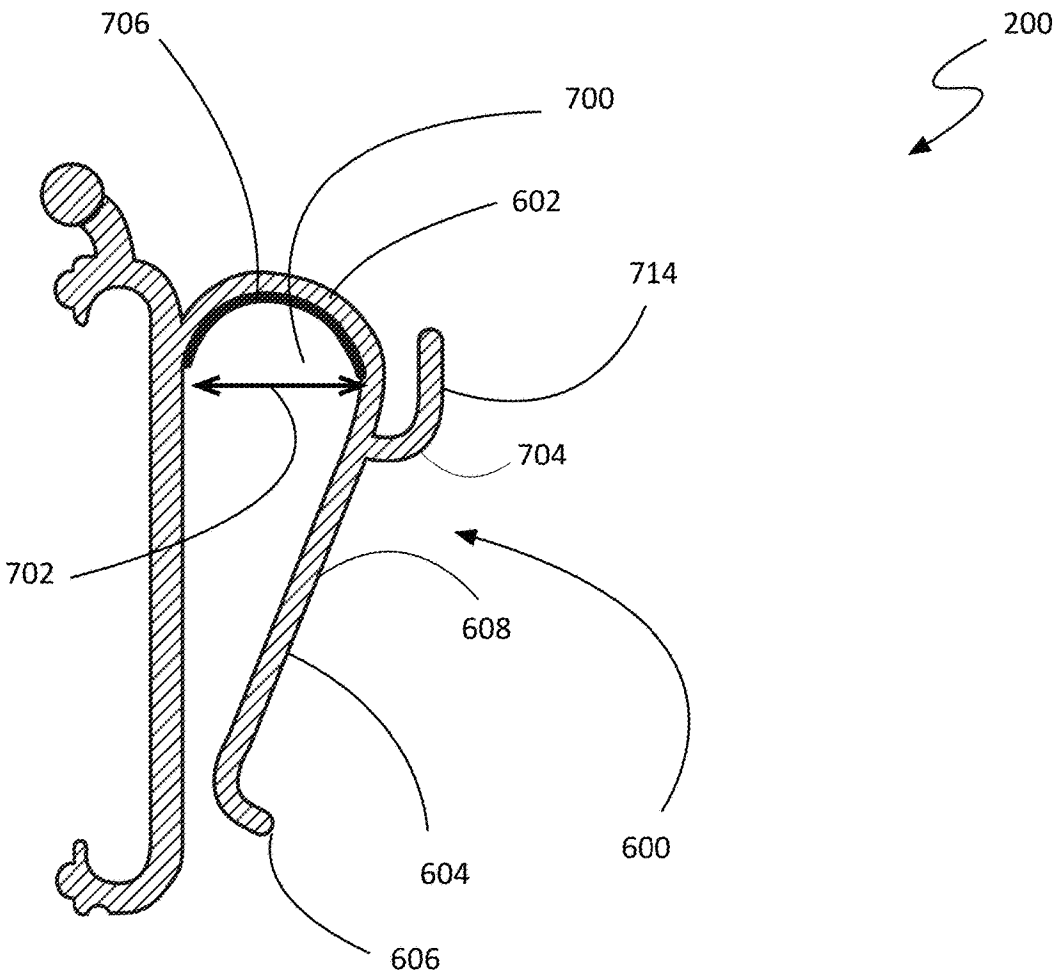
FIG. 7*a* is a cross-sectional view of the second cover body of FIG. 6.
Figure 7B:
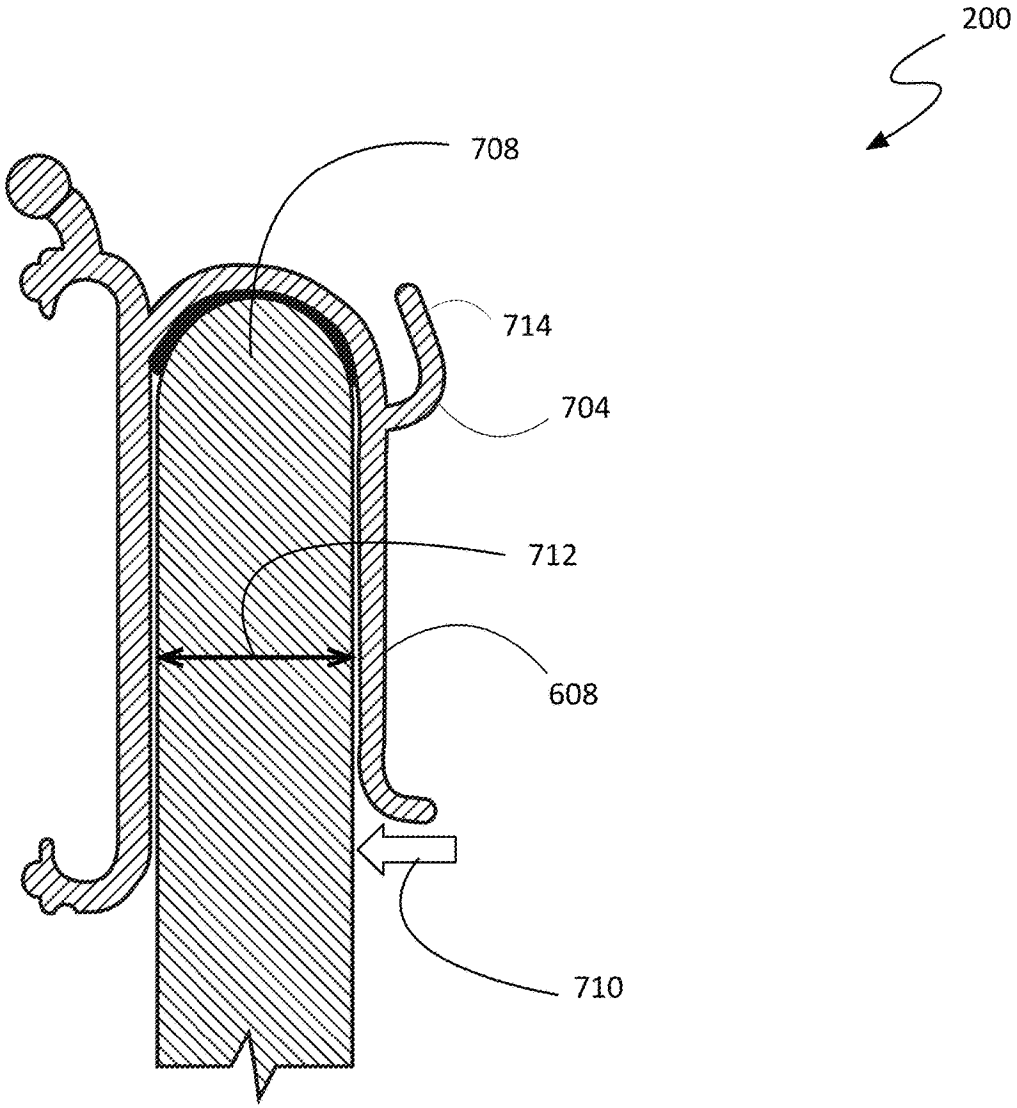
FIG. 7*b* is a cross-sectional view of the second cover body of FIG. 6 after being attached to a hospital bed.

FIG. 6 shows a front view of a non-limiting example of a second cover body 200 whose attachment mechanisms 114 are clips 600. FIGS. 7*a* and 7*b* are cross-sectional views of the second cover body 200 of FIG. 6, along D-D. As shown, each clip 600, comprises a head portion 602 that extends upward and curves outward, then downward from the second cover body 200, partially encircling a receiving void 700 then tapering (e.g. angling back toward the second cover body 200) downward to a tail portion 604 that is less curved and terminating at a tail end 606 that is biased, the bias 710 being toward the second cover body 200.

Before proceeding, it should be noted that, in discussing the elements that make up various embodiments of a clip 600, the term "downward" is used as a contrast to "upward" being used to describe the initial trajectory of the head portion 602 after interfacing with the second cover body 200, and should not be taken as an indication or limitation of the orientation of any part of the clip 600 with respect to any other part of the modular dispenser 100 (e.g. the clip 600 could be angled with respect to the second cover body 200, etc.).

In the context of the present description and the claims that follow, a receiving void 700 refers to the volume, or cross-sectional area of a volume, that can be occupied by a structure that the clip 600 is attached to while functioning within normal use conditions (e.g. clip 600 is not strained to a breaking point by inserting an object that is too large, etc.). This void 700 has a width 702. In the context of the present description and the claims that follow, the width 702 of a receiving void 700 refers to the largest distance within the head portion 602, normal to the second cover body 200. In other words, it is the thickness of the void 700, as measured from the second cover body 200. Furthermore, in the same context, to at least partially encircle said receiving void 700 means to trace at least part of the perimeter or surface of the void. Regarding these definitions, the distinction between volume/surface and cross-sectional area of a volume/perimeter depends upon if the head portion 602 has a cross section that is substantially constant as the cutting plane propagates along a line.

FIG. 7*a* shows a non-limiting example of a clip 600 that in a free position in which the clip 600 is not engaged with anything, while FIG. 7*b* shows that same clip 600 in a hooked position in which the clip 600 is engaged with a hospital bed 708. When engaged with a desired location (e.g. the rail of a hospital bed 708), the biasing of the tail end 606 may help prevent inadvertent removal or disengagement of the modular dispenser 100 from the location. In some embodiments, the bias 710 is such that, when not engaged, the tail end 607 is in contact with the second cover body 200, while in others the tail end 607, while in a relaxed state, is not in contact with the second cover body 200. Furthermore, according to various embodiments, the clip 600 may be shaped and/or composed of a material that, in addition to providing the bias 710, is flexible enough that the tail portion 604 is deflectable away from the second cover body 200 to a distance 712, measured like the previously discussed width 702, that is at least equal to the width 702 of the receiving void 700. In some embodiments, the width 702 of the void 700 is at least 4 cm, while in other embodiments, the width 702 is at least 6 cm, 8 cm, 10 cm, or larger. FIGS. 7*a* and 7*b* also illustrate that, in some embodiments, the clip 600 comprises a straight portion 608 and the utility hanger 704 comprises a straight portion 714. When the clip 600 is in the free position, as shown in FIG. 7*a*, the straight portion 608 of the clip 600 may be oblique with respect to the second cover body and the straight portion 714 of the utility hanger 704 may be substantially parallel to the second cover body. When the clip 600 is in the hooked position, the straight portion 608 of the clip 600 may be parallel to the second cover body and the straight portion 714 of the utility hanger 704 may be oblique with respect to the second cover body.

In some embodiments, the clip 600 may further comprise a segment 706 of the head portion 602 that is facing the void 700 that is composed of, coated with, or coupled to, an elastomeric material that is non-slip, thereby enhancing the grip the clip 602 can exert on the various structures it may be engaged with. The non-slip segment 706 may comprise an elastomer, or any other non-slip or grip material known in the art. Improving the grip, combined with the bias 710, may allow the clip 600 to maintain the modular dispenser 100 in an orientation that may be at odds with gravity (e.g. tipped at an angle, etc.), which may allow it to be positioned for easier access by the patient.

As shown in FIGS. 7*a* and 7*b*, in some embodiments, the clip 600 may further comprise a utility hanger 704. In some embodiments, a utility hanger 704 may be coupled to a clip 600 after formation, while in others it may be integral with the clip 600. The utility hanger 704 is essentially a hook, extending outward from the clip 600, away from the second cover body 200, curving upward. It may be beneficial to have a means to hang a bag or other item from the modular dispenser 100. For example, in embodiments where the modular dispenser 100 is dispensing hygiene wipes, it may be advantageous to hang a bag for receiving used wipes near the dispenser 100, for easy access. Furthermore, while this discussion of a utility hanger 704 has been done in the context of a clip 600, it should be noted that one or more utility hangers 704 could be coupled to or integral with any of the other attachment mechanisms 114 contemplated herein, or either of the cover bodies.

Figure 8:
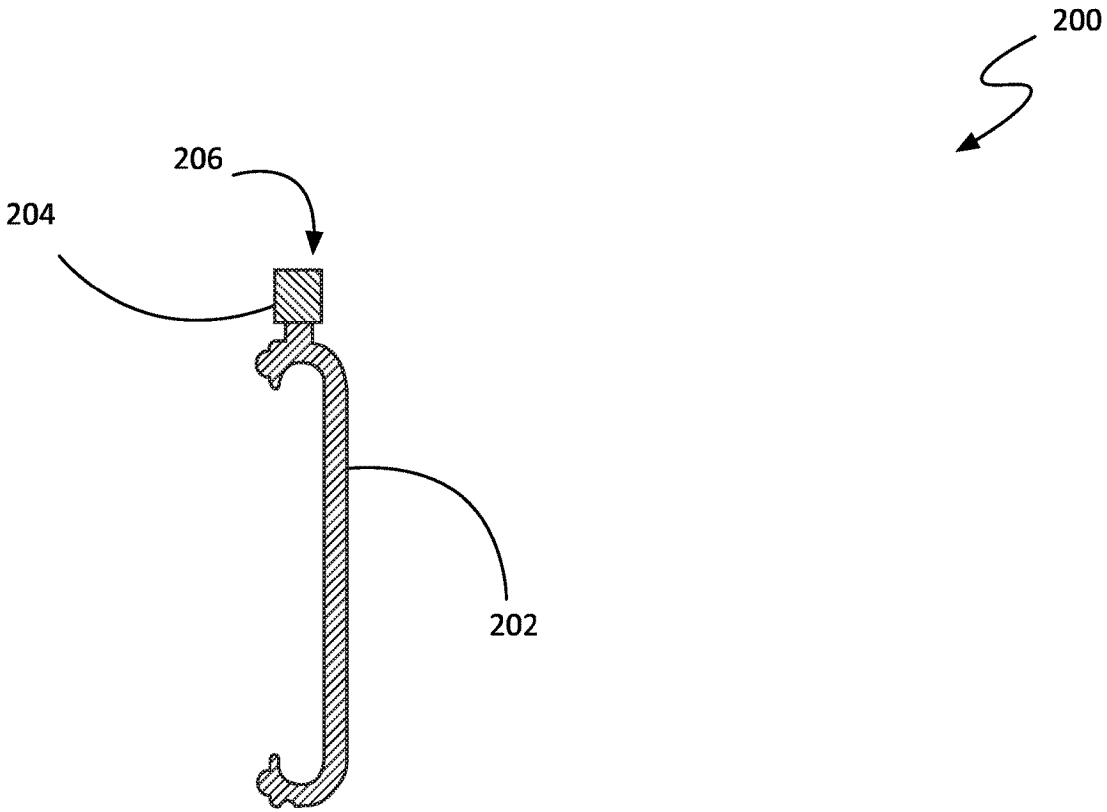
FIG. 8 is a cross-sectional view of the second cover body of FIG. 2.
Figure 9:
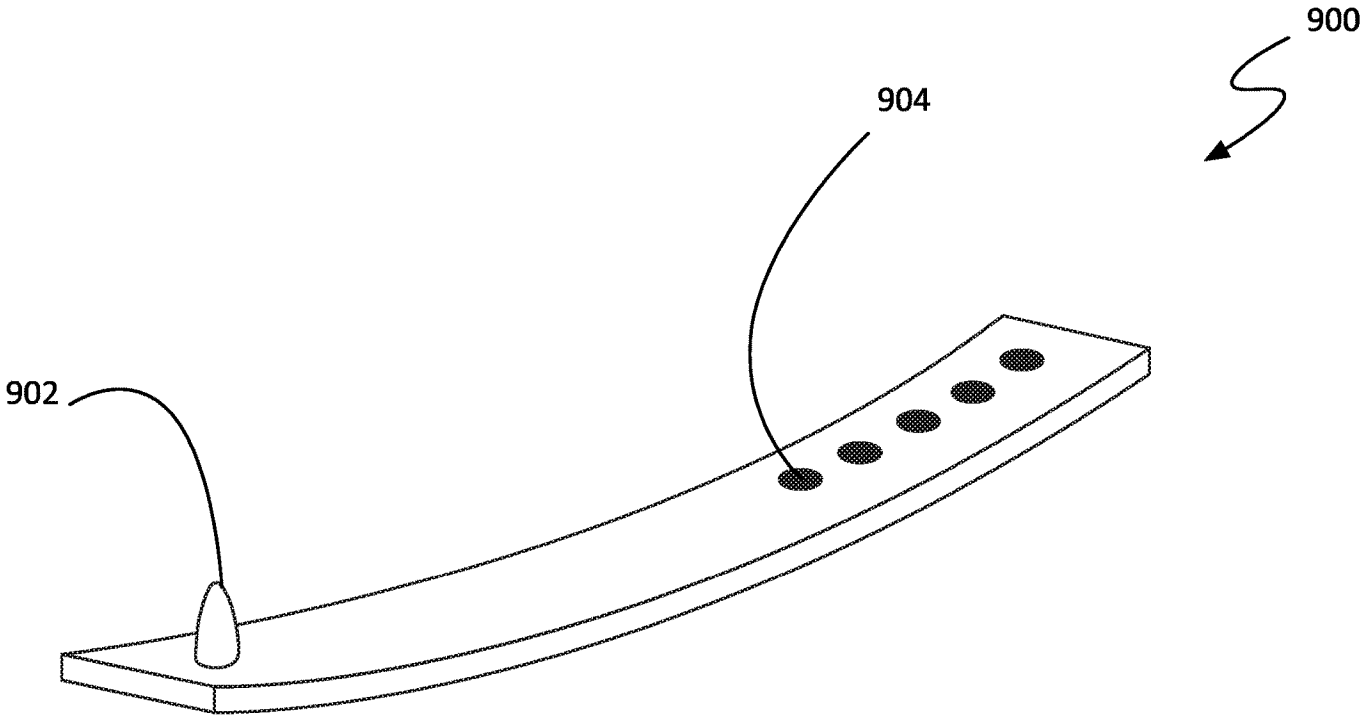
FIG. 9 is a perspective view of a strap.

FIG. 2 is a rear view of a modular dispenser 100, but may also be considered a front view of a non-limiting example of a second cover body 200 having two strap-based attachment mechanisms 114, each comprising a strap receiver 204 configured to receive a strap 900. FIG. 8 shows a cross-sectional view of said second cover body 200, along line B-B, and FIG. 9 shows a perspective view of a strap 900. The use of a strap 900 as an attachment mechanism 114 may be advantageous as it is able to adjust to a wide range of shapes and sizes of target locations.

According to various embodiments, the strap receiver 204 can be configured as a loop or buckle or any other configuration that is capable of engaging the strap 900. For example, in some embodiments, the strap receiver 204 may be a loop having at least one flat side 206, allowing the strap to sit flush with the loop.

The strap 900 itself may releasably couple to itself, or to the receiver 204, to engage a target location. For example, in some embodiments, the strap 900 may comprise one or more holes 904 and a strap male member 902 that is configured and arranged to be received within the holes 904. In some aspects, the strap 900 can be at least partially fed through the strap receiver 204 and then coupled to the hospital bed rail/gurney rail, or other structure, using the holes 904 and strap male member 902. As such, the attachment mechanism 114 and strap 900 can support the modular dispenser 100 when coupled to the rail. Moreover, in some embodiments, more than one strap 900 can be provided to be placed through one or more of the strap receivers 204.

In some embodiments, the strap 900 may comprise a substantially flexible and/or sterilizeable material, such as silicone, elastomer, or any other similar material. The strap 900 may be flat and ribbon-like in some embodiments, round and cord-like in others, but may also have any other cross-sectional shape known in the art.

Figure 11:
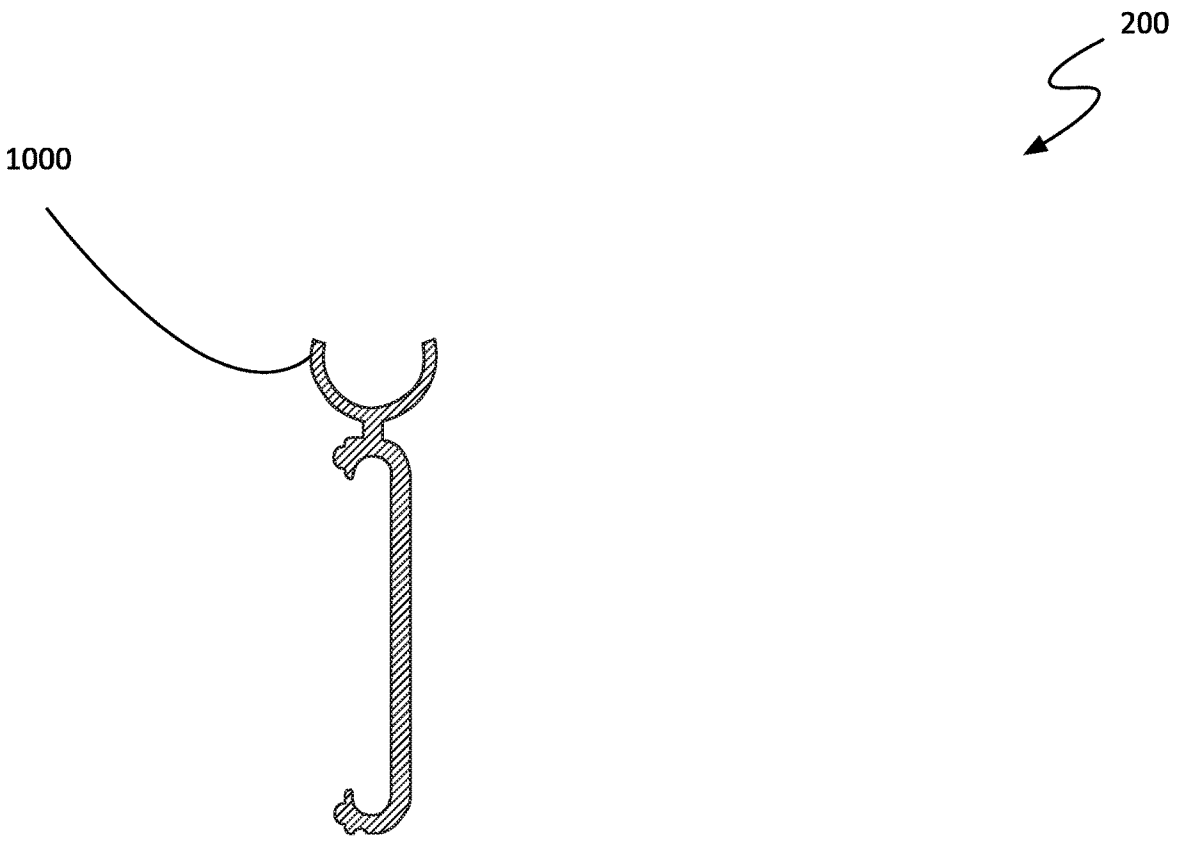
FIG. 11 is a cross-sectional view of the second cover body of FIG. 10.

FIG. 10 is a front view of a non-limiting example of a second cover body 200 with clamps 1000 as attachment mechanisms 114. FIG. 11 is a cross-sectional view of said body, along line E-E. According to various embodiments, a clamp 1000 is an attachment mechanism 114 that is capable of engaging a portion of a hospital bed or gurney (e.g., the rail) or any other cylindrical location. In particular, the clamp 1000 may be configured and arranged as a semi-flexible and biased manner in which the modular dispenser 100 can be attached to the rail of a hospital bed, gurney or other desired location. When the desired location (e.g., the rail of a hospital bed) is generally cylindrical in configuration, the clamp 1000 can be configured in a semi-circular manner such that the clamp 1000 can be engaged to the desired location. In particular, the user can provide a force to bias the clamp(s) 1000 against the rail and then the clamp(s) 1000 will then engage the rail and retain in place the modular dispenser 100. In some embodiments, the modular dispenser 100/second cover body 200 can comprise a plurality of clamps 1000, such as two clamps 1000. In some embodiments, the modular dispenser 100 may comprise one or more clamps 1000 and one or more other attachment mechanisms 114.

In some embodiments, the modular dispenser 100 may include any combination of attachment mechanisms 114. For example, the modular dispenser 100 may comprise one or more clip 600 together with one or more clamps 1000 and/or straps 900. These configurations can be selected based at least partially on the end user's needs and requirements.

Figure 12:
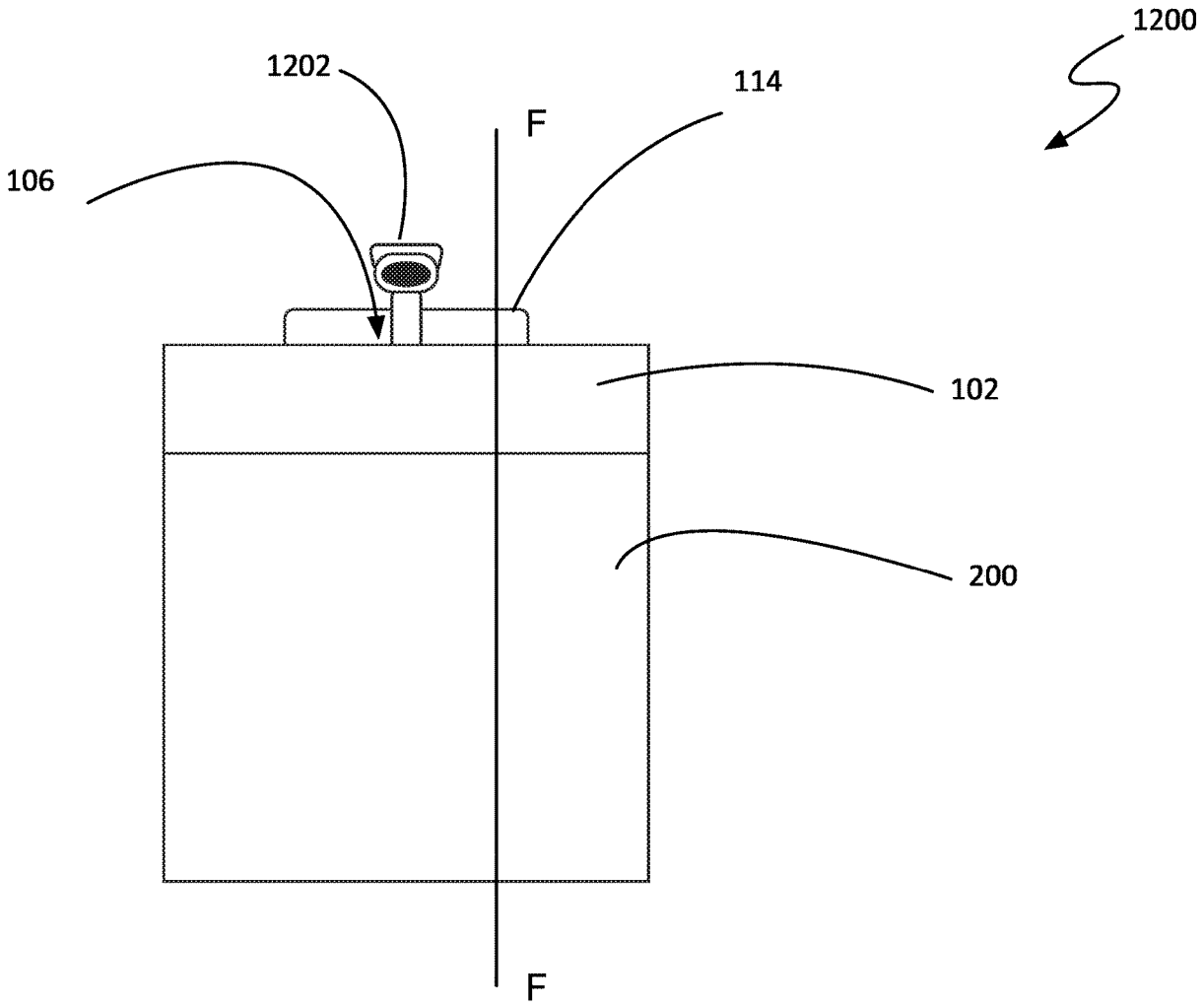
FIG. 12 is a front view of a modular dispenser.
Figure 13:
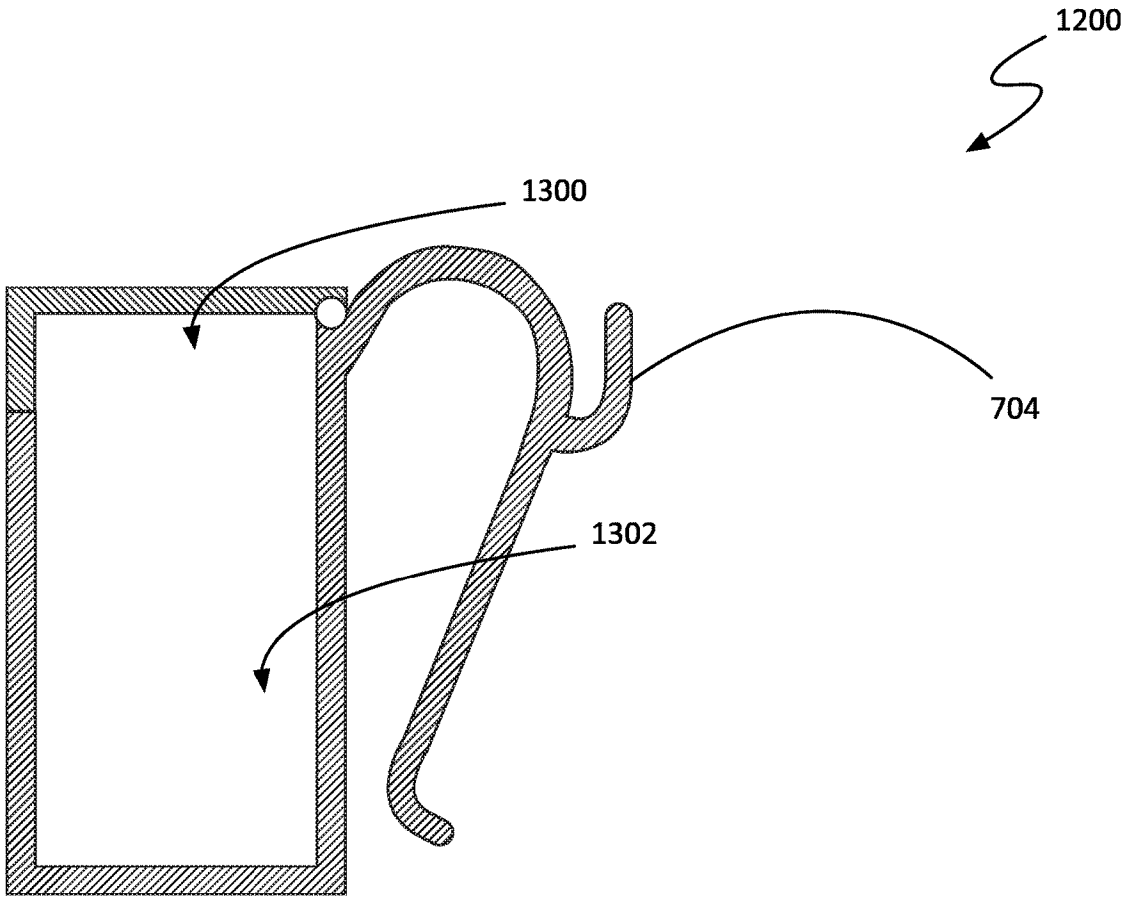
FIG. 13 is a cross-sectional view of the modular dispenser of FIG. 12.

FIGS. 12 and 13 show various views of a non-limiting example of a modular dispenser 1200 configured to dispense a fluid product, such as sanitizing gel. FIG. 12 is a front view of the modular dispenser 1200, and FIG. 13 is a cross-sectional view, along line F-F, of the modular dispenser 1200 of FIG. 12.

In some embodiments, the second cover body 200 can be configured and arranged to hold the fluid within the cavity 302. In some embodiments (not pictured), other aspects of the modular dispenser 1200 (e.g., the first cover body 102) can be configured and arranged to hold some or all of the fluid. For example, in some aspects, the fluid may comprise a liquid or a gel such as a composition used for sanitizing or cleansing (e.g., a composition comprising alcohol or a detergent). In other embodiments, the fluid may comprise an aerosolized composition that can be used for like uses.

As shown in FIG. 12, the first cover body 102 can be coupled to the second cover body 200 in a substantially similar manner to retain the fluid within the cavity 302 and the attachment mechanism 114 can be similarly positioned to attached the modular dispenser 1200 to a hospital bed, gurney, or other desired location, as described above.

In some aspects, the first cover body 102 may comprise one or more devices or mechanisms to dispense the liquid contained within the cavity 302 (not shown). For example, the first cover body 102 (or other aspects of the modular dispenser 10) may comprise a hand pump, atomizer, or any other device that is capable of dispensing the fluid. In other embodiments, the first cover body 102 can be opened and the user/patient/caregiver can directly access the fluid stored in the cavity 302.

In some embodiments, the aperture 106 of the first cover body 102 may be configured to releasably couple to a fluid or gel dispensing mechanism 1202, such as those discussed above. In some embodiments, the modular dispenser 1200 may be formed as a single-use device, intended to be disposed of once all the liquid has been dispensed, while in other embodiments, the liquid may be refilled.

Embodiments of a modular dispenser configured to dispense liquid may have shapes that differ from those intended to dispense solid products, such as wipes. For example, as shown in FIG. 13, the second cover body 200 may be much deeper, whereas embodiments intended for wipes may be wider but shallow. Furthermore, the cavity 302 intended for holding a fluid sometimes relies mainly on the second cover body 202, which makes it easier to prevent leaks through a first and second cover body interface. As a specific example, in some embodiments, a volume 1300 enclosed by the first cover body 102 may be less than ¼ the volume 1302 enclosed by the second cover body 200.

Some embodiments may receive a fluid directly into the cavity 302 for dispensing. Other embodiments may be configured to receive a vessel containing the fluid. For example, in one embodiment, the second cover body 200 may be configured to receive a bottle of sanitizing gel. As an option, one or more dimensions of the cavity 302 (e.g. internal surfaces of the cavity 302) may be biased or otherwise movable (e.g. spring-loaded, articulated, etc.) such that the cavity 302 may conformed to different shapes, allowing it to mate or better enclose different shaped vessels. Furthermore, some embodiments may omit the first cover body 102 entirely, making use of the second cover body 200 and one or more attachment mechanisms 114.

Some embodiments of the modular dispenser contemplated herein provide significant advantages compared to conventional hygiene wipe dispensers and other dispensers of sanitizing products. For example, a conventional dispenser of hygiene wipes may be placed on an over-bed tray, at a patient's bedside, or even in a patient's bed. Unfortunately, all of these positions are subject to being moved by a caregiver or the patient such that when the patient requires use of the hygiene wipes (e.g., after use of the bed pan or a urinal or prior to eating or drinking), the patient may not be able to access the wipes. Moreover, even if not moved from a position adjacent to the patient, the conventional dispensers may pose an obstacle for a caregiver seeking to access the patient. Provided herein is an improvement relative to those conventional systems. For example, by providing reverse coupling to the rail of a hospital bed or gurney, the patient may readily access the hygiene wipes contained in the modular dispenser while the dispenser, by being coupled to the rail, poses little to no obstacle for the caregiver.

Where the above examples, embodiments and implementations reference examples, it should be understood by those of ordinary skill in the art that other embodiments and examples could be intermixed or substituted with those provided. In places where the description above refers to particular embodiments of a modular dispenser, it should be readily apparent that a number of modifications may be made without departing from the spirit thereof and that these embodiments and implementations may be applied to other dispensers and healthcare devices as well. Accordingly, the disclosed subject matter is intended to embrace all such alterations, modifications and variations that fall within the spirit and scope of the disclosure and the knowledge of one of ordinary skill in the art.

What is claimed is:

1. A modular dispenser configured to provide access to a hygiene product to an immobile patient in a hospital bed, the modular dispenser comprising:

a first cover body comprising a first face having an aperture;

a second cover body hingedly coupled to the first cover body through at least one hinge, the first cover body and second cover body movable between an open position and a closed position, the second cover body comprising a second face that is opposite the first face of the first cover body when in the closed position, the first cover body and second cover body together defining a cavity when in the closed position, the cavity configured to contain the hygiene product, wherein the hygiene product is accessible through the aperture of the first cover body;

at least one attachment mechanism integral with the second cover body and configured to removably attach to a rail of the hospital bed and position the hygiene product in a location accessible to the patient, wherein the at least one attachment mechanism comprises a clip having a clip opening oriented in a downward direction, a tail end curving away from the second cover body, and a utility hanger separated from the tail end and formed as a hook extending outward from the clip with a hook opening oriented in an upward direction opposite the downward direction, wherein the hook is configured to support a disposal receptacle for receiving items to be disposed of and wherein the clip comprises a non-slip segment configured to enhance the grip of the clip and allow the clip to maintain the modular dispenser in an angled orientation with respect to the rail of the hospital bed; and a moisture lock comprising silicone and coupled to one of the first cover body and the second cover body and disposed along the interface between the first cover body and the second cover body when in the closed position;

wherein the modular dispenser is configured to provide the patient in the hospital bed with reliable access to the hygiene product without interfering with care provided to the patient; and wherein each of the clip and the utility hanger comprises a straight portion, wherein the clip is configured to move between a free position and a hooked position, wherein when the clip is in the free position, the straight portion of the clip is oblique with respect to the second cover body and the straight portion of the utility hanger is substantially parallel to the second cover body, and when the clip is in the hooked position, the straight portion of the clip is parallel to the second cover body and the straight portion of the utility hanger is oblique with respect to the second cover body, and wherein the clip is biased toward the free position.

2. The modular dispenser of claim 1, further comprising an aperture seal disposed over the aperture, the aperture seal comprising an elastomeric material and having a slit that is biased closed.

3. The modular dispenser of claim 2, further comprising an aperture cover hingedly coupled to the first cover body and covering the aperture seal, the aperture cover composed of the same material as the first cover body.

4. The modular dispenser of claim 1, further comprising a gel dispensing mechanism releasably coupled to the first cover body and passing through the aperture, wherein a volume enclosed by the first cover body is less than ¼ a volume enclosed by the second cover body.

5. The modular dispenser of claim 1, wherein the clip has a head portion partially encircling a receiving void and tapering downward to a tail portion having a tail end, the clip being sufficiently flexible that the tail portion is deflectable away from the second cover body to a distance at least equal to a width of the receiving void.

6. The modular dispenser of claim 5, wherein the receiving void is at least 4 cm wide.

7. The modular dispenser of claim 1, wherein first face and the second face are substantially parallel while in the closed position, and wherein the first face and the second face are both closer to vertical than horizontal when the at least one attachment mechanism is engaged with a hospital bed.

8. A modular dispenser configured to provide access to a hygiene product to an immobile patient in a hospital bed, the modular dispenser comprising:

a first cover body having an aperture;

a second cover body hingedly coupled to the first cover body through at least one hinge, the first cover body and second cover body movable between an open position and a closed position, the first cover body and second cover body together defining a cavity when in the closed position, the cavity configured to contain the hygiene product, wherein the hygiene product is accessible through the aperture of the first cover body; and at least one attachment mechanism coupled to the second cover body and configured to attach to a rail of the hospital bed and position the hygiene product in a location accessible to the patient, wherein the at least one attachment mechanism comprises a clip having a clip opening oriented in a downward direction, a tail end curving away from the second cover body, and a utility hanger separated from the tail end and formed as a hook extending outward from the clip with a hook opening oriented in an upward direction opposite the downward direction, wherein the hook is configured to support a disposal receptacle for receiving items to be disposed of and wherein the clip comprises a non-slip segment configured to enhance the grip of the clip;

wherein the modular dispenser is configured to provide the patient in the hospital bed with reliable access to the hygiene product without interfering with care provided to the patient; and wherein each of the clip and the utility hanger comprises a straight portion, wherein the clip is configured to move between a free position and a hooked position, and wherein when the clip is in the free position, the straight portion of the clip is oblique with respect to the second cover body and the straight portion of the utility hanger is substantially parallel to the second cover body, and when the clip is in the hooked position, the straight portion of the clip is parallel to the second cover body and the straight portion of the utility hanger is oblique with respect to the second cover body.

9. The modular dispenser of claim 8, further comprising a moisture lock comprising an elastomer coupled to one of the first cover body and the second cover body and disposed along the interface between the first cover body and the second cover body when in the closed position.

10. The modular dispenser of claim 8, wherein the clip has a head portion partially encircling a receiving void and tapering downward to a tail portion having a tail end, the clip being sufficiently flexible that the tail portion is deflectable away from the second cover body to a distance at least equal to a width of the receiving void, the tail end being biased toward the second cover body.

11. The modular dispenser of claim 8, further comprising a lock coupled to the first cover body and movable between an unlocked position and a locked position, wherein the lock is engaged with a lock port on the second cover body while in the locked position.

12. A modular dispenser configured to provide access to a hygiene product to an immobile patient in a hospital bed, the modular dispenser comprising:

a first cover body having an aperture;

a second cover body releasably coupled to the first cover body, the first cover body and second cover body together enclosing a cavity, the cavity configured to contain the hygiene product, wherein the hygiene product is accessible through the aperture of the first cover body; and at least one attachment mechanism coupled to the second cover body and configured to attach to a rail of the hospital bed and position the hygiene product in a location accessible to the patient, wherein the at least one attachment mechanism comprises a clip having a clip opening oriented in a downward direction, tail end curving away from the second cover body, and a utility hanger separated from the tail end and formed as a hook extending outward from the clip with a hook opening oriented in an upward direction opposite the downward direction, wherein the hook is configured to support a disposal receptacle for receiving items to be disposed of;

wherein the modular dispenser is configured to provide the patient in the hospital bed with reliable access to the hygiene product without interfering with care provided to the patient; and wherein the clip is configured to move between a free position and a hooked position, wherein when the clip is in the free position, the clip is oblique with respect to the second cover body and the utility hanger is substantially parallel to the second cover body, and when the clip is in the hooked position, the clip is parallel to the second cover body and the utility hanger is oblique with respect to the second cover body.

13. The modular dispenser of claim 12, wherein the clip has a head portion partially encircling a receiving void and tapering downward to a tail portion having a tail end, the clip being sufficiently flexible that the tail portion is deflectable away from the second cover body to a distance at least equal to a width of the receiving void, the tail end being biased toward the second cover body.

14. The modular dispenser of claim 13, wherein the clip further comprises an elastomeric material that is non-slip along a segment of the head portion that faces the receiving void.

15. The modular dispenser of claim 12, further comprising a gel dispensing mechanism releasably coupled to the first cover body and passing through the aperture.

16. The modular dispenser of claim 12, further comprising an aperture seal disposed over the aperture, the aperture seal comprising an elastomeric material and having a slit.

* * * * *